United States Patent [19]

Neff

[11] 4,163,329

[45] Aug. 7, 1979

[54] APPARATUS FOR RESURFACING A SNOW LAYER

[76] Inventor: Josef Neff, Toggenburgerstrasse 114, Wil, Schweiz, Switzerland

[21] Appl. No.: 873,017

[22] Filed: Jan. 27, 1978

[30] Foreign Application Priority Data

Jan. 28, 1977 [CH] Switzerland ..... 1087/77

[51] Int. Cl.[2] ..... E01H 4/00

[52] U.S. Cl. ..... 37/10; 172/149; 172/150; 172/182

[58] Field of Search ..... 37/10; 172/537, 539, 172/541, 554, 605, 140, 149, 150, 151, 153, 155–157, 170, 171, 174, 175, 177, 182, 197, 199; 404/201, 96

[56] References Cited

U.S. PATENT DOCUMENTS

| | | | |
|---|---|---|---|
| 34,828 | 4/1862 | Gross | 172/170 |
| 780,785 | 1/1905 | Dorsett | 172/140 |
| 832,978 | 10/1906 | Jensen | 172/170 |
| 979,255 | 12/1910 | Brown | 37/10 |
| 1,171,084 | 2/1916 | Barrett | 172/150 |
| 1,198,684 | 9/1916 | Waugh et al. | 172/150 X |
| 2,786,283 | 3/1957 | Bradley | 172/175 X |
| 2,915,839 | 12/1959 | Erickson | 172/170 |
| 3,794,122 | 2/1974 | Rohrer | 172/149 X |
| 3,889,760 | 6/1975 | Manor | 172/175 |
| 4,056,328 | 11/1977 | Maxey | 37/10 X |

*Primary Examiner*—E. H. Eickholt

[57] ABSTRACT

The disclosed apparatus is a machine of the type for connection to a snow skiing course maintenance tractor. It has freely-rolling rollers for compacting the snow and a plurality of scrapers arranged side by side. The scrapers are pivoted vertically about an axis which is adjustable in height. The scrapers are arranged in front of the rollers.

Also disclosed is such a machine with combinations of scrapers and rollers arranged on side by side sub-frames which are connected together by a linkage. When one of the sub-frames is tilted in one direction, the other sub-frame is caused by the linkage to tip in the opposite direction. Means are disclosed for utilizing only one of the sub-frames alone.

6 Claims, 5 Drawing Figures

APPARATUS FOR RESURFACING A SNOW LAYER

BACKGROUND OF THE INVENTION

The present invention relates to an apparatus for the preparing or reconditioning the surface of snow skiing courses, or runs, of ski slopes.

The original way of preparing ski runs surfaces consisted of pressing new snow flat by means of rollers. This approach is still used today when sufficient new snow has fallen.

More and more, however, it is necessary to recondition the surfaces of ski runs which have been worn by intensive use. At present, the demand for resurfacing of worn ski runs is about equal to the demand for initial conditioning of runs that have been newly snowed over. This resurfacing is necessary because intensive use of the ski run results at certain locations, particularly on steep run sections, in the formation of an uneven, wavey surfaces having rises and dips. Such a surface requires the less expert skiers to slow down and to execute strenuous avoidance maneuvers.

There is already known a type of apparatus for evening out the irregularities of such uneven ski run sections. One such apparatus includes a driveable chassis provided with a horizontal beam extending the full width of the chassis and carrying a continuous scraper blade at its leading edge. Another has an upright blade provided at the bottom edge with a number of teeth extending to loosen the hard-packed snow of the rises.

The disadvantage of such continuous wide scrapers lies in that they extend over too wide an area to effectively level the relatively small rises. In the course of their forward movement, some portion of the scrapes is likely to strike a rise which raises the scraper at that point and thereby changes the level of the blade along its entire length to prevent it from evenly biting to the desired depth. The result is that other rises at that location are only scraped superficially. The snow thus scraped off settles in the dips between the rises and remains there, usually in the form of hard clumps which are difficult to ski over. It is therefore necessary to work these areas with a further apparatus to loosen and break up the clods and then to pack them down with a roller.

There have been attempts to remedy the disadvantages of these wide scrapers by mounting a number of relatively short scrapers on a frame so that their blades are substantially horizontal and extend in a line across the width. The blades of the scrapers are attached to arms which pivot vertically to permit them to follow the contour of the run surface. A number of relatively wide runners glide side by side in a row in front of the blades. The height of the runners relative to the frame is adjustable. The frame, which is supported in the front on the runners and in the rear on the scraper arms, thus changes its attitude to the surface when the height of the runners is changed. The change in attitude of the frame then results in a change in the pitch of the scraper blades.

It has proved in practice that even this last-described apparatus has major shortcomings. As the runners follow a raised contour, the forward portion of the apparatus becomes raised, thereby changing the pitch of the scraper blades and preventing them from biting in to a sufficient depth. Furthermore, such apparatus likewise leaves the area covered with loose clumps which must again be worked with a further apparatus. So, similar problems arise here also.

SUMMARY OF THE INVENTION

The novel apparatus in accordance with the present invention features a plurality of scrapers arranged side by side and pivoted vertically about an axis which is adjustable in height. The scrapers are disposed in front of rollers for packing down the snow.

The novel apparatus levels a ski run which has developed an uneven surface, breaks up the scraped off clumps, and packs down the material thus loosened in such a way as to form once more a suitably smooth surface.

With this arrangement, the effectiveness of the scrapers is not significantly influenced by the surface contour, and the scrapers can therefore cut deeply into even the higher rises. This results in a substantially even layer of loose snow which can be readily packed down evenly by the rollers which follow, so that the area worked by the apparatus is once again restored to a smooth ski run.

DESCRIPTION OF THE PREFERRED EMBODIMENT

Figure 1:
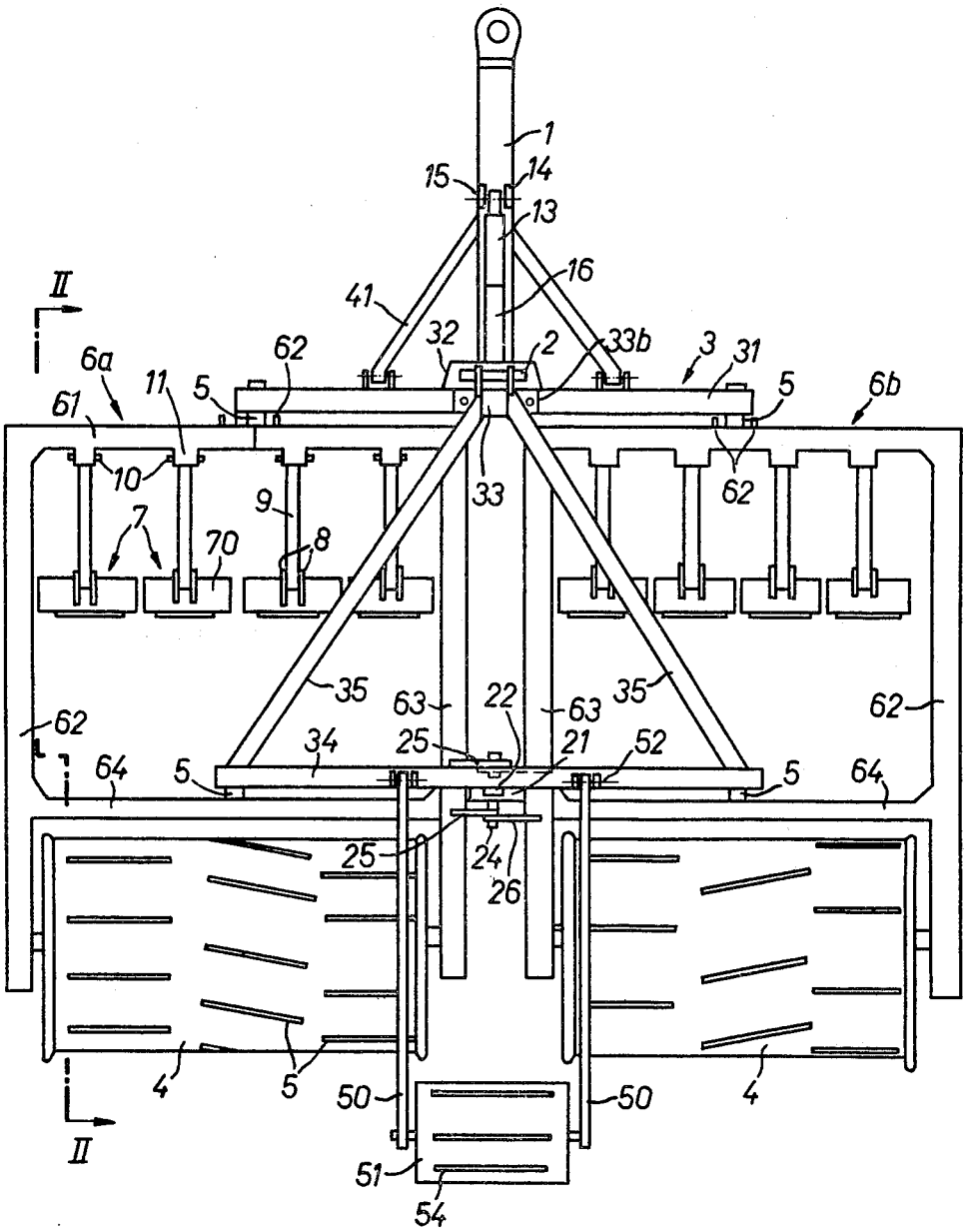
FIG. 1 is a top view of an apparatus in accordance with a preferred embodiment of the present invention.

A preferred embodiment of the present invention is the ski run resurfacing machine shown in the FIG. 1 of the drawings. The machine is suited for connection to a motorized ski run maintenance tractor, such as for example those generally used for towing compacting rollers. For this purpose there is provided a draw bar 1. This is connected to a horizontally oriented main frame 3 by means of a horizontal pivot joint 2, so that the angle between the main frame 3 and the draw bar 1 can be controlled, as will be later described. The main frame 3 is supported at the rear in an indirect fashion on two rollers 4 in a manner which likewise will be described later.

Figures 2, 3, 4, 5:
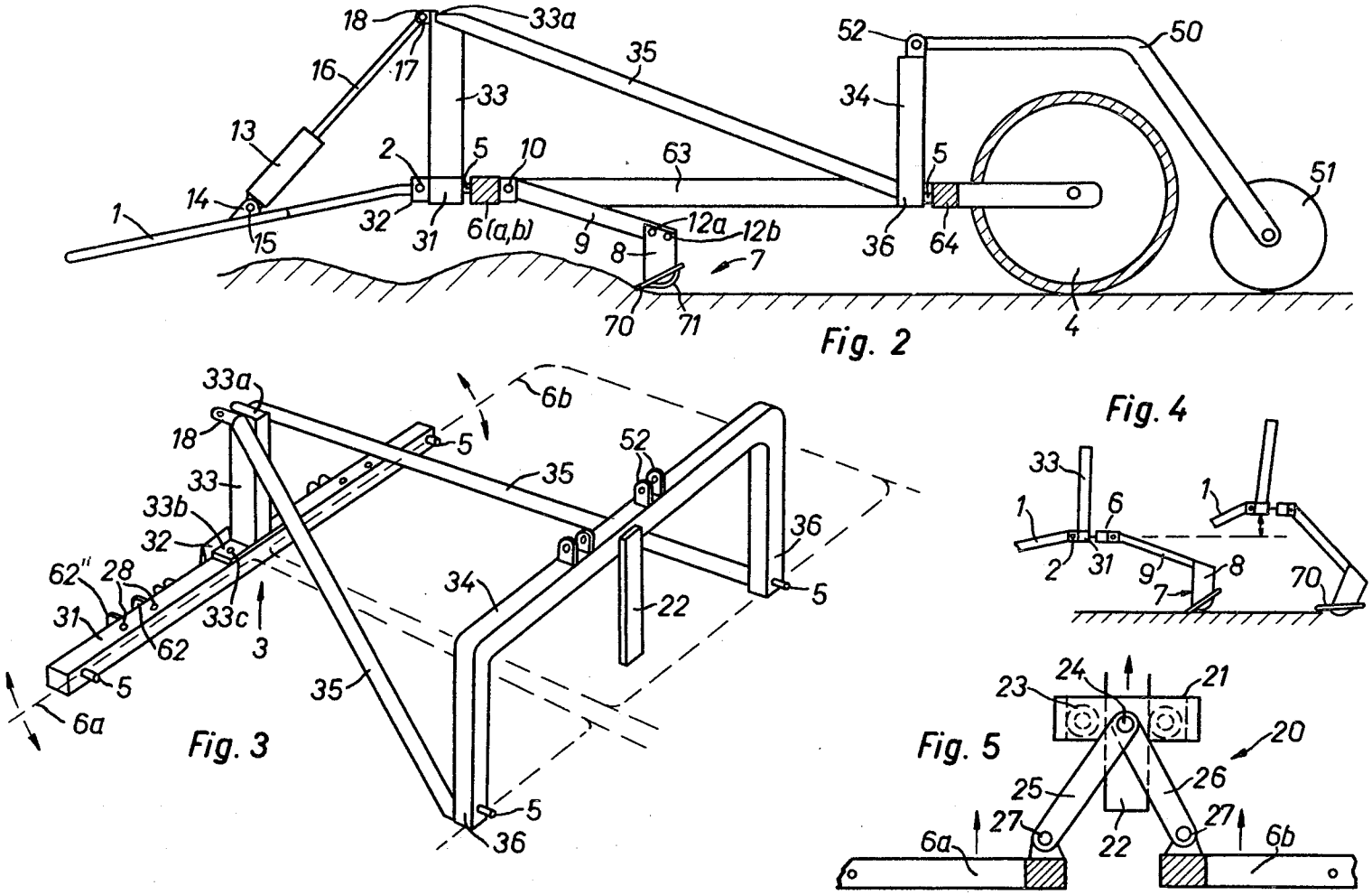
FIG. 2 is a side sectional view of the apparatus of FIG. 1 taken along the section line II—II.
FIG. 3 is a perspective view of the main frame of the apparatus of FIG. 1.
FIG. 4 is a partially schematic illustration showing adjustment of the pitch of the scraper blades of the apparatus of FIG. 1.
FIG. 5 is a partially sectioned view of a fragment of the apparatus of FIG. 1 illustrating a linkage between two sub-frames of the apparatus.

As may be seen from the FIG. 3, the main frame 3 has a front crossmember 31 with a gudgeon plate 32 in the middle for a gudgeon pin 2. A vertical post 33 is threaded to the projection 32. At the rear is a nearly portal-shaped rear cross member 34 and two struts 35 in the form of strong tubes which extend from the upper end 33*a* of the post 33 diagonally and slanting downward to the free ends of the rear cross member 34. By this arrangement, the frame 3 is made sufficiently resistant to torsion to be substantially unaffected by the degrees of torsion to which it is likely to be exposed in use. The front cross member 31 and ends of the rear cross member 34 each carry two horizontal trunnion studs 5, the axes of which are parallel to the towing direction of the machine and which extend towards the rear from their respective cross members. The central axis of each strut 35 intersects the central axis of the rear studs exactly in the center of the ends 36, so that the least possible bending moments are transmitted.

Two sub-frames 6a, 6b are mounted on the studs 5. In this manner each of the sub-frames 6a, 6b is so arranged that it can tilt at its front or rear stud 5 precisely about its longitudinal axis. Each sub-frame 6a, 6b carries a number of scrapers 7 and one of the rollers 4 and likewise features a front cross member 61, two longitudinal supports 62, 63, and a rear cross member 64 which is spaced some distance from the rear end of the longitudinal supports 62 and connects them together. Scraper blades 70 are mounted in front of the rollers 4 by means of plates 8 attached to pivot arms 9 which pivot vertically about a horizontal scraper trunnion 10, each trunnion being attached to the front cross member 61. The trunnions 10 are formed at the rear side of the front cross member 61 by suitable plates 11. Each scraper blade 70 is pivotable independently of the other scraper blades 70. As may be seen from the FIG. 2, the scraper blades 70 are welded to the plates 8, and the latter fastened to the pivot arm 9 by means of a shear pin 12a and a bolt 12b which serves as a pivot whenever the shear pin is sheared. On the lower side, the scraper blades 70 carry a curved sheet metal runner 71 which permits a backward motion of the machine after work with it has been completed without causing the scrapers 7 to dig into the surface. These runners 71 also provide a certain amount of control for the scrapers 7 in the towing direction, in that they prevent the scrapers 7 from digging too deeply into the surface.

The arrangement of the scrapers 7 in front of the rollers 4 is of particular significance. In contrast to the functioning of prior resurfacing machines, the surface contour is here no longer followed directly in the front, but rather the scraper blades 70 present a particular pitch to the over all surface. As may be seen from the FIG. 4, the action of the scrapers 7 depends upon this pitch. The higher the cross member 61 of the sub-frames 6a, 6b is raised from the surface (it being roughly at the same height as is the cross member 31 of the main frame), the steeper is the slant of the pivot arms 9 and the less pitch the scraper blades 70 have relative to the surface. How the pitch may be adjusted to a new setting will be described in the following.

For adjusting the scraper blade 70 pitch, there is provided on the draw bar 1 a hydraulic cylinder unit 13. It is pivotably mounted there by means of gudgeon plates 14 and pivotable about a gudgeon pin 15. Its piston rod 16 connects pivotably to a further gudgeon pin 17 through gudgeon plates 18 which extend from the upper end 33a of the post 33. If the piston rod 16 is now extended, then the distance between the pivots 15 and 17 becomes greater. Since the draw bar 1, however, is fastened to the tractor and cannot move down, the distance between the pivots 15, 17 can become greater only by the raising up of the post 33, and with it the cross member 31. The angle between the draw bar 1 and the main frame 3 is thereby made smaller. That is, the draw bar 1 is at more of a slant to the main frame 3. With the lifting of the main frame 3, and therewith of the two cross members 61, 62, the pivot arms 9 are also dropped into a steeper position. As was mentioned before, this results in a reduced pitch of the scraper blades 70. If, in reverse procedure, the piston rod 16 is drawn back, then the post 33 of the connected draw bar 1 moves down, the pivot arms 9 are given a less steep position, and therefore, the pitch of the scraper blades 70 is increased. When the machine is drawn forward, there are superimposed upon this basic setting of the scraper blades 70 the movements which each of the individual scrapers makes independently of the movements of the other scrapers by reason of the local uneven contours. The choice of pitch for the scraper blades 70 is determined for the most part by the degree of unevenness of the surface, and also by the condition of the snow.

It is noted as a significant advantage that the pivot arms 9 are fastened immediately adjacent that portion of the machine which undergoes the maximum raising and lowering in response to the height adjustment mechanism. This maximizes the degree of adjustment possible for the scraper blades 70.

As was previously mentioned, the sub-frames 6a, 6b are mounted on the main frame 3 so that they can pivot. However, they should not have the capability of pivoting independently of one another, for it could occur in working across a run that each subframe 6a, 6b and its roller 4 would work separate paths lying on different planes and separated by a shoulder. In order to prevent this, there is provided a linkage member 20 which will be described in the following discussion in relation to FIG. 5.

The linkage member 20 consists of a carriage block 21 about a guide rail 22 which is attached to the rear cross member 34 and extends downward there, as can be seen also from FIG. 3. Inside of each narrow end of the carriage block 21 is a ball bearing 23 which rides against the guide rail 22. A trunnion stud 24 extends outward from the midpoint of each of the longer sides of the carriage block 21. These studs 24 are for fastening two linkage struts 25, 26 on each side, with the other ends of the struts 25, 26 being connected to further trunnion studs on the sub-frames 6a, 6b, so that each sub-frame 6a, 6b is connected by two struts 25, 26 with the carriage block 21. If, for example, as seen facing forward the sub-frame 6a should tilt toward its right side, as a result of its left side running over a snow clump scraped up by the scrapers 7, then it will pull the carriage block 21 down by means of its struts 25. Through the action of the struts 26, this will bring about a tilting of the other sub-frame 6b in the opposite direction of rotation. It can occur that the other sub-frame 6b offers a large resistance to this tilting because its roller 4 lies flat on the surface along its entire width. This has the effect of reducing the tendency of the sub-frame 6a to tilt, with the result that the roller 4 of sub-frame 6a presses on the snow clods with a significantly greater force than is attributable to just its own weight. In this way the snow clods are reliably crushed, so that there results a suitably smooth ski run surface which may be immediately used. It is even better to permit the crushed and compacted material, which as described results from the scraped rises, to lie overnight before use. The run will then on the following day be in particularly favorable condition.

The present machine is intended primarily for downhill ski runs. However, since each of the sub-frames 6a, 6b has all the elements necessary for the surface conditioning, at least one of the sub-frames may be provided with means for using it alone. These means may be, for example, two threaded holes 28 in the upper side of the front cross-member 61. The vertical post 33, which is welded to a base plate 33b fastened to the cross member 31 with bolts is removed therefrom and bolted to the cross member 61. There are also provided two gudgeon plates 62' to permit the fastening thereto of a drawbar such as the drawbar 1, but without the reinforcement struts 41. After connection of the drawbar, it is necessary only to mount the piston-cylinder unit 13. With that, the width of the machine is reduced to one-half, so that it may now be used to condition relatively narrow ski touring and mountaineering trails, which then are sufficiently conditioned that they need only to be again reestablished.

The rear cross member 34 of the main frame 3 also serves to hold a pivoted pair of curved arms 50 which draw a smaller roller 51. These arms 50 are attached to gudgeon plates 52 on the cross-member 34 so that they pivot vertically. The roller 51 acts on the strip between the two large rollers 4 which is not contacted by them. In contrast to the rollers 4, which have numerous rows of ribs 53, the middle roller 51 has only a single row of ribs 54.

I claim:

1. Apparatus for the resurfacing of a snow layer, said apparatus being of the type for connection to a tractor, having rollers for compacting the snow, and having a plurality of scrapers arranged side by side and having pivots for pivoting said scrapers vertically about an axis which is adjustable in height, the improvement therein comprising that in the direction of movement of said apparatus said scrapers are arranged in front of said rollers, that the pivots of said scrapers are disposed immediately adjacent the front of a horizontally oriented main frame which is supported at its rear end on said rollers, and that a draw bar is attached to the front of said main frame by means of a pivotable horizontal shaft for connecting said machine to a tractor, said draw bar and said main frame also being connected to an adjustment member which is adjustable in length to alter the degree of slant of said draw bar to the plane of said main frame.

2. Apparatus according to claim 1, and wherein said adjustment member comprises a hydraulic cylinder unit with its cylinder pivotably connected to said draw bar and its piston rod connected to a post fixed substantially vertically to said main frame.

3. Apparatus according to claim 1 and comprising:

a pair of sub-frames mounted between a front cross member and a rear cross member of said main frame, said sub-frames being disposed side by side relative to the forward direction of said apparatus and being pivotably held by studs extending rearwardly from the outer end portions of said front and rear crossmembers of said main frame, a plurality of said scrapers being attached to the front portion of each of said sub-frames, and a roller being attached to the rear portion of each of said sub-frames.

4. Apparatus according to claim 3 and comprising a linkage carrier riding along a vertical guide rail fixed to said main frame and connected to the adjacent portions of said sub-frames by struts, whereby a sideways tilting of one of said sub-frames results in a sideways tilting of the other of said sub-frames in a direction of rotation opposite that of said one sub-frame.

5. Apparatus according to claim 4 wherein each of said sub-frames is pivotable about its longitudinal axis.

6. Apparatus according to claim 5 and wherein at least one of said sub-frames comprises, means for fastening said vertical post to a front cross member of said sub-frame, and means for pivotably attaching a drawbar to said sub-frame.

* * * * *